US006779634B1

(12) United States Patent
Slagle

(10) Patent No.: US 6,779,634 B1
(45) Date of Patent: Aug. 24, 2004

(54) DUMB WAITER ELEVATING AND LOWERING PLATFORM DEVICE

(76) Inventor: Wayne M. Slagle, 1228 NE. 193rd Ave., Portland, OR (US) 97230

( * ) Notice: Subject to any disclaimer, the term of this patent is extended or adjusted under 35 U.S.C. 154(b) by 0 days.

(21) Appl. No.: 09/473,194

(22) Filed: Dec. 6, 1999

(51) Int. Cl.[7] ..... B66B 11/08

(52) U.S. Cl. ..... 187/251; 187/239; 187/240; 182/141

(58) Field of Search ..... 187/401, 242, 187/406, 414, 239, 240, 254, 261, 262, 900, 250–252, 256, 264, 266, 594; 182/141, 148, 142–144; 254/242, 329, 331, 334, 335

(56) References Cited

U.S. PATENT DOCUMENTS

| | | | | | |
|---|---|---|---|---|---|
| 536,927 | A | * | 4/1895 | Gregory | 182/141 |
| 717,672 | A | * | 1/1903 | Gartner | 187/262 |
| 1,006,044 | A | * | 10/1911 | Barlow | 187/401 |
| 2,531,346 | A | * | 11/1950 | Schuchert | 187/239 |
| 2,963,178 | A | * | 12/1960 | Walker | 187/239 |
| 2,996,151 | A | * | 8/1961 | Olson | 187/406 |
| 3,016,989 | A | * | 1/1962 | Lindmark | 187/401 |
| 3,845,842 | A | * | 11/1974 | Johnson | 187/401 |
| 3,908,801 | A | * | 9/1975 | Pohlman | 187/372 |
| 3,910,382 | A | * | 10/1975 | Justice | 187/406 |
| 3,931,727 | A | * | 1/1976 | Luenser | 188/1.11 L |
| 4,015,685 | A | * | 4/1977 | Lenz | 182/142 |
| 4,166,517 | A | * | 9/1979 | Henderson | 187/401 |
| 4,557,353 | A | * | 12/1985 | Pichon | 187/401 |
| 5,149,242 | A | * | 9/1992 | Haymore | 187/262 |
| 5,465,808 | A | * | 11/1995 | Musgrove | 182/2 |
| 5,562,164 | A | * | 10/1996 | McMurray | 169/54 |
| 5,667,035 | A | * | 9/1997 | Hughes | 182/142 |
| 6,012,552 | A | * | 1/2000 | Del Rio | 187/264 |
| 6,026,937 | A | * | 2/2000 | Hayashi et al. | 187/401 |
| 6,167,670 | B1 | * | 1/2001 | Reite et al. | 187/401 |

FOREIGN PATENT DOCUMENTS

| | | | | |
|---|---|---|---|---|
| CH | 620171 | * | 11/1980 | 187/261 |

* cited by examiner

*Primary Examiner*—Paul T. Chin
(74) *Attorney, Agent, or Firm*—Scwabe, Williamson & Wyatt, P.C.

(57) ABSTRACT

An elevating system is provided that includes a platform that may travel up and down a tower through the use of a pair of cables, pulleys mounted at the top of the tower and a low profile motor mounted near the bottom of the tower to selectively raise and lower the platform by winding and unwinding of the cables.

10 Claims, 1 Drawing Sheet

DUMB WAITER ELEVATING AND LOWERING PLATFORM DEVICE

FIELD OF THE INVENTION

The present invention relates to dumbwaiter elevating and lowering platforms and, more particularly, to motor-driven platforms for use in confined spaces and especially useful in residential applications.

BACKGROUND OF THE INVENTION

The first dumbwaiters were screw drive. The current winding drum is the most popular type of drive, consisting of a drive motor connected to a gear reducer by either direct drive or V-belts. The drum winds a cable to raise the load and several limit switches are used to set the travel limits. A disc brake is used to lock and hold the input or output shafts. The drive mechanism normally mounts below the platform, limiting the lower travel unless the drive is located below ground. Also, the platform car is usually made of sheet metal that allows any spilled materials to leak down the wall, inside the hoistway. Some systems allow for mechanical operation by pulling on a rope that, through a set of pulleys on a common shaft, raises or lowers the platform car connected to a rope.

There is a need for a dumbwaiter that does not require that the drive mechanism be located below ground in order for the platform to reach the lower level of travel. Further, there is a need for a dumbwaiter that has fewer components and easier to install.

SUMMARY OF INVENTION

An elevating system that moves a payload container or platform from one elevation to another. Such an elevating system allows the platform to stop at predetermined positions as needed between floors of a building or residences by depressing a "raise", "lower" or "stop" switch. A remote control module permits operation from a location within visual sight of the switch. The lift mechanism is comprised of a low profile torque motor integral to the rotating cylinder that wraps a cable, which through a system of pulleys, raises the payload. The low profile motor allows the payload to lower to a ground position without a hole below ground for the motor and is mounted to the bottom of the tower. The payload is lowered by reversing the rotation of the motor with gravity acting on the payload. The motor incorporates an integral electromagnetic brake. Also incorporated into the low profile motor is a rotary counter that sets the stop locations of the platform without the use of limit switches in the hoist way. The container is a single piece, made of roll molded plastic. A lip surrounds the front opening and prevents spills from exiting the container and dripping down the inside walls of the hoist way.

DESCRIPTION

In the following detailed description, reference is made to the accompanying drawing which form a part hereof and in which is shown by way of illustration a specific embodiment in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

The following description will be directed to a dumbwaiter incorporating the commercially available SOMFY HiPro LT50 motor, by SOMFY SYSTEMS, INC., Cranbury, N.J., as described in "The SOMFRY HiPro LT50 Motor Line" product catalogue, 1996, incorporated herein by reference, and at www.somfysystems.com. However, it is to be understood that other motors of substantially similar design can also be used to practice the invention.

Figure 1:
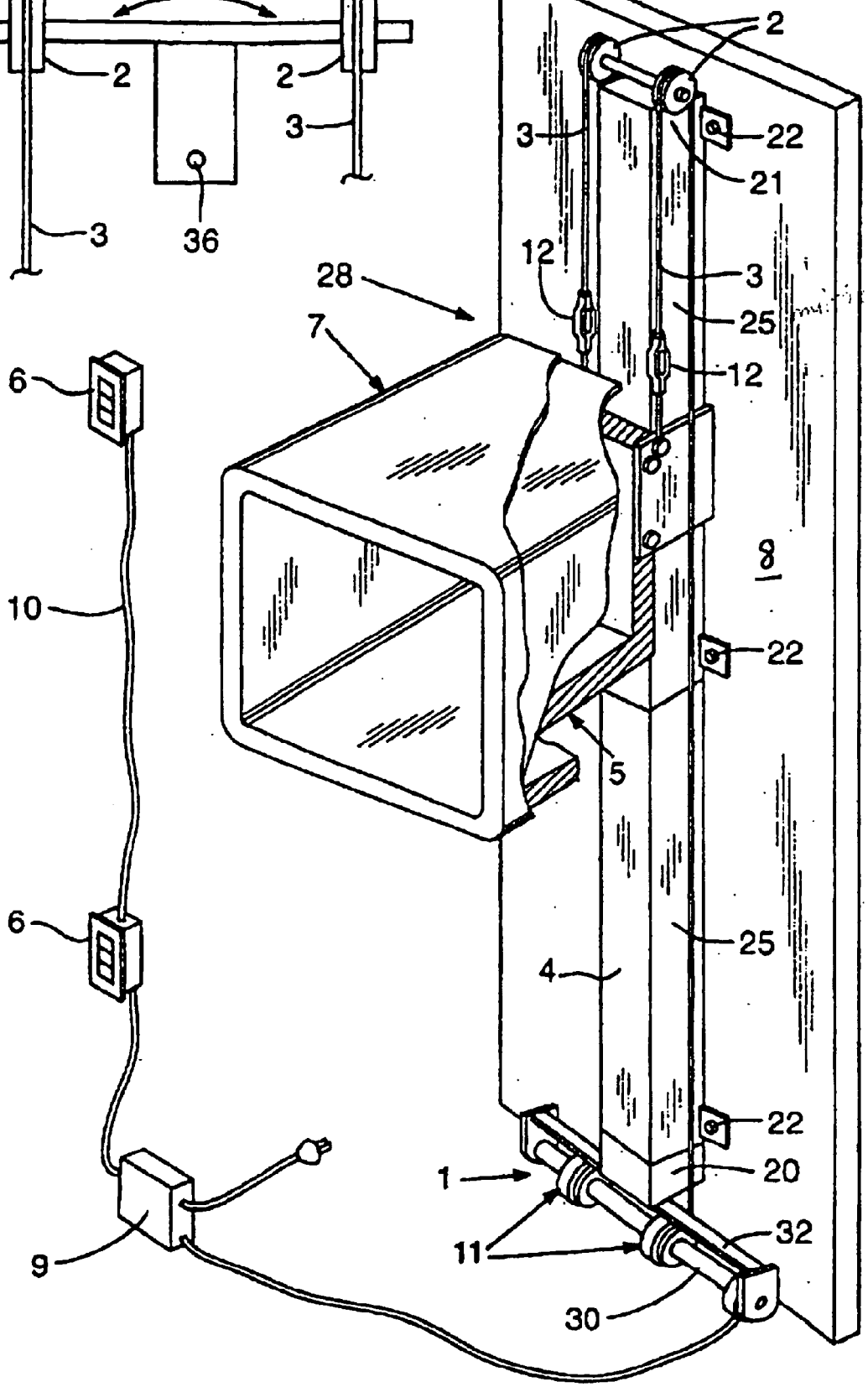
FIG. 1 is a perspective partial cut-away view of a dumbwaiter in accordance with an embodiment of the invention.

FIG. 1 is a perspective view of a dumbwaiter 28 in accordance with an embodiment of the invention. The dumbwaiter 28 provides a platform or container 7 that has the capability to raise or lower at the control of the user for carrying supplies up or down one or more levels of a building. The dumbwaiter 28 can be used, for example, but not limited to, in a residential installation to raise groceries or other supplies from a lower level to an upper level.

The dumbwaiter 28 comprises a tower assembly 4, a drive motor 1, a pair of cables 3, a pulley system 2, and a platform connection 5 upon which a container 7 is mounted. The drive motor 1 located adjacent a tower lower portion 20 and the pulley system 2 is located adjacent the tower top portion 21. The drive motor 1 winds or unwinds the pair of cables 3 which are directed through the pulley system 2 and coupled to the platform connection 5. The platform connection 5 is guided and supported by the tower assembly 4 as the platform connection 5 is raised and lowered.

The high torque, low profile drive motor 1 mounts to the base 20 of the tower assembly 4. In one embodiment in accordance with the invention, the drive motor 1 is the commercially available SOMFY HiPro LT50 motor (SOMFY SYSTEMS, INC., Cranbury, N.J.). The SOMFY HiPro LT50 motor is an asynchronous motor, an electromagnetic disk brake, planetary gear mechanism, and limit switch integrated into a compact cylinder-shaped housing. An end ring drives an outer shaft casing 30 in a clockwise or counter-clockwise direction, the number of revolutions in each direction being controlled by the limit switch.

Coupled to the outer shaft casing 30 are two spaced-apart sheaves 11 which revolve with the outer shaft casing 30. The sheaves 11 are spaced apart such that they are on either side of the tower 4. Coupled to each sheave 11 is a cable 3 that winds and unwinds, on and off, respectively, the sheaves 11 with the revolution of the outer shaft 30. Coupled to the drive motor 1 is a cable guide bar 32 that directs the cables 3 onto and off of the two sheaves 11.

Figure 2:
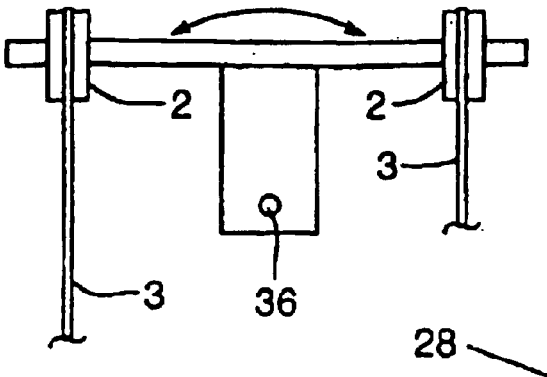
FIG. 2 is a front view of the pivoting mount for the pulleys.

The cables 3 are connected through a pulley system 2 that is mounted to the uppermost portion of the tower 4. The pulley system 2 is mounted in such a way as to allow for slight changes in cable 3 length due to cable 3 extension or winding problems from side to side. FIG. 2 shows the pulley system 2 comprising a pivoting mount 36 for the pulleys allowing for variations in cable length during operation while still having balanced tension in each cable. Coarse adjustment of the length of each cable 3 is provided by turnbuckles 12 coupled between the cables 3 and the platform connection 5. The two cable 3 arrangement provides for a redundant cable 3 for safety in case one cable 3 is severed, as one cable 3 is sufficient to support the platform connection 5. Since the two sheaves 11 are coupled to the same outer shaft casing 30, the cables 3 are unwound or rewound in even fashion such that the platform connection 5 remains level and balanced.

The tower assembly 4 is provided in multiple sections 25 to allow each section to be fed through the access door of the hoist way rather than having to build the hoist way around a single piece tower. The tower assembly 4 mounts to the rear wall 8 of the hoist way with the use of lag bolts 22.

The container 7 is of one piece construction, custom made from a roll mold process, that mounts onto the platform connection 5 that is attached to the tower 4 and raised by the cables 3. Bushing material, not shown, provides a low friction bearing surface between the platform connection 5 and the tower 4.

The controls 6 for raising, lowering, and stopping the container 7 are mounted to walls near the access doors. The controls 6 are connected to the controller 9 that provides motor control through a wiring harness 10. The limit switch internal to the drive motor 1 is set to stop at various predetermined number of revolutions corresponding to the different levels. The limit switch being integral to the drive motor 1 eliminates the need to have individual limit switches at each level. The limit switch is based on counting the number of revolutions or partial revolutions of the outer shaft casing 30.

The electromagnetic brake which is integral with the drive motor 1 provides for a non-wearing, maintenance free, quiet and safe operation. The brake being integral to the drive motor 1 eliminates the need for a braking system on the platform connection. The drive motor 1 holds the platform connection 5 in a stationary locked position by default, and only releases the platform connection 5 during the raising or lowering operation.

The low profile of the drive motor 1 allows for a completely above-ground installation of the dumbwaiter 28. Further, since the motor, gears and brake are internal to the shaft 30, the drive motor 1 is especially quiet as compared with external motors and belt-driven pulleys and cable.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A dumbwaiter comprising:

a tower assembly defining a vertical track;

a container for receiving and delivering materials, the container slidably coupled to the track for vertical movement of the container between vertically spaced apart positions;

a pair of upper sheaves mounted at the top of the tower assembly, wherein the upper sheaves are rotatably coupled to a sheave mount, the sheave mount pivotally mounted at the top of the tower assembly to thereby respond to a change in length of either cable by pivoting to retain a balanced load on each cable;

a pair of lower sheaves mounted at the bottom of the tower assembly; and a pair of lifting cables each having a first end mounted to the container and extended there from over one of the upper sheaves and extended there from to one of the lower sheaves, a second end of each cable attached to and wound onto the corresponding one of the lower sheaves, the lower sheaves fixedly mounted to a rotatable cylindrical shaft, the cylindrical shaft encasing a drive motor and engaged by the drive motor for selective rotation of the shaft and accordingly the lower sheaves to thereby wind and unwind the lifting cables to selectively raise and lower the container.

2. The dumbwaiter of claim 1, wherein at least one cable further comprises a turnbuckle adapted to allow adjustment of the length of the at least one cable such that both cables are substantially the same length.

3. The dumbwaiter of claim 1, wherein the drive motor is selected from the SOMFY HiPro LT50 line of motors.

4. The dumbwaiter of claim 1, further comprising a guide bar adjacent to and parallel with the cylindrical shaft and spaced a distance from the lower sheaves, the guide bar adapted to guide the two or off of the lower sheaves in a preferred direction.

5. The dumbwaiter of claim 1, wherein the container is of a one-piece construction and adapted to contain a fluid spill.

6. A dumbwaiter for raising and lowering a platform, comprising:

a cylindrical shaft encasing a drive motor and engaged by the drive motor for selective rotation of the shaft, the drive motor comprising an asynchronous motor, an electromagnetic disk brake, a planetary gear mechanism and a limit switch;

a tower assembly having a tower upper end, a tower lower end, a left side and a right side, the cylindrical shaft being adjacent the tower lower end; two spaced-apart sheaves coupled to the cylindrical shaft each of the sheaves in substantially vertical alignment with the left side and the right side;

a pair of cables each having a first end and a second end, each first end coupled to one of the two sheaves;

a pulley system pivotally mounted above the tower upper end to thereby respond to a change in length of either cable by pivoting to retain a balanced load on each cable, the pulley system having two spaced-apart pulleys in substantial vertical alignment with the two spaced-apart sheaves, each cable routed through one of the two pulleys;

a platform connection slidably received on the tower, both cable second ends coupled to the platform connection; and a container coupled to the platform connection, the outer shaft case adapted to rotate in a first direction to unwind the two cables from their corresponding sheaves causing the platform connection to be lowered, and a second direction to wind the two cables onto their corresponding sheaves causing the platform connection to be raised.

7. The dumbwaiter of claim 6, wherein one or both cables further comprise a turnbuckle adapted to allow adjustment of the length of at least one cable such that both cables are substantially the same length.

8. The dumbwaiter of claim 6, wherein the drive motor is selected from the SOMFY HiPro LT50 line of motors.

9. The dumbwaiter of claim 6, further comprising a guide bar adjacent to and parallel with the cylindrical shaft and spaced a distance from the two sheaves, the guide bar adapted to guide the two cables onto or off of the sheaves in a preferred direction.

10. The dumbwaiter of claim 6, wherein the container is of a one-piece construction and adapted to contain a fluid spill.

* * * * *